US005963141A

United States Patent [19]

Takamatsu

[11] Patent Number: 5,963,141

[45] **Date of Patent: *Oct. 5, 1999**

[54] APPARATUS FOR CHECKING IDENTIFICATION SIGNAL AND METHOD THEREOF

[75] Inventor: Hiroyuki Takamatsu, Kanagawa, Japan

[73] Assignee: Sony Corporation, Tokyo, Japan

[ * ] Notice: This patent is subject to a terminal disclaimer.

[21] Appl. No.: 08/854,167

[22] Filed: May 9, 1997

[30] Foreign Application Priority Data

May 16, 1996 [JP] Japan ..... 8-121870

[51] Int. Cl.[6] ..... G08G 1/00

[52] U.S. Cl. ..... 340/825.31; 340/825.31; 340/825.34; 340/825.69; 340/825.72; 341/176

[58] Field of Search ..... 340/825.31, 825.54, 340/825.69, 825.72; 341/176

[56] References Cited

U.S. PATENT DOCUMENTS 4,509,093 4/1985 Stellberger ..... 340/825.54
5,473,318 12/1995 Martel ..... 340/825.69

*Primary Examiner*—Brian Zimmerman
*Assistant Examiner*—Yves Dalencourt
*Attorney, Agent, or Firm*—Frommer Lawerence & Haug, LLP.; William S. Frommer; Dennis M. Smid

[57] ABSTRACT

An identification signal checking apparatus includes an apparatus (1) to be detected having a first wireless transmitting and receiving unit (4), a first signal processing unit (3) and a first memory unit (5) for storing an identification signal and includes a detecting device (10) having a second wireless transmitting and receiving unit (11), a second signal processing unit (12), a second memory unit (13) for storing an identification signal, and a communication permission signal generating means (14), being arranged such that the apparatus (1) to be detected transmits a communication request signal, when receiving a communication permission signal transmitted from the detecting apparatus (10) based on the communication request signal within a predetermined period, the apparatus (1) to be detected transmits the identification signal stored in the first memory unit (5) to the detecting apparatus (10), and the detecting apparatus (10) checks whether or not the transmitted identification signal coincides with the identification signal stored in the second memory unit (13).

14 Claims, 3 Drawing Sheets

APPARATUS FOR CHECKING IDENTIFICATION SIGNAL AND METHOD THEREOF

BACKGROUND OF THE INVENTION

The present invention relates to an identification signal checking apparatus and an identification signal checking method which are suitable for use in a keyless entry system.

A keyless entry system has been proposed. In this keyless entry system, infrared rays or radio waves are used to transmit an identification signal from a key apparatus side to a lock apparatus side for the locking or the unlocking.

Such keyless entry system employs a one-way communication in which the key apparatus side constantly transmits the same identification signal. Therefore, when this communication is intercepted, the identification signal may disadvantageously be stolen easily.

Particularly when the identification signal is transmitted by using the infrared rays, it is possible to copy the identification signal easily by a so-called learning remote controller, which has already been developed into a social problem.

Moreover, since in the above keyless entry system it is possible to detect a specific identification signal by using each of various identification signals to detect whether or not each of the identification signals is agreed with the specific identification signal, there is the critical disadvantage in security.

SUMMARY OF THE INVENTION

In view of such aspects, it is therefore an object of the present invention to improve the security of the keyless entry system with a comparatively simple arrangement.

An identification signal checking apparatus of the present invention includes an apparatus to be detected having a first wireless transmitting and receiving unit, a first signal processing unit and a first memory unit for storing an identification signal and includes a detecting apparatus having a second wireless transmitting and receiving unit, a second signal processing unit, a second memory unit for storing an identification signal, and a communication permission signal generating means. The apparatus to be detected transmits a communication request signal. When receiving a communication permission signal transmitted from the detecting apparatus based on the communication request signal, the apparatus to be detected transmits the identification signal stored in the first memory unit to the detecting apparatus. The detecting apparatus checks whether or not the transmitted identification signal is agreed with the identification signal stored in the second memory unit.

According to the present invention, only when the apparatus to be detected (key apparatus) receives the communication permission signal from the detecting apparatus (lock apparatus) for a predetermined period, for example, the apparatus to be detected (key apparatus) transmits the identification signal to the detecting apparatus (lock apparatus). Therefore, the period of transmitting this identification signal is limited, and hence the security is improved.

DESCRIPTION OF THE PREFERRED EMBODIMENT

An identification signal checking apparatus and an identification signal checking method according to an embodiment of the present invention will be described with reference to the accompanying drawings. In this embodiment, the identification signal checking apparatus and method are applied to a keyless entry system for opening and closing a door.

Figure 1:
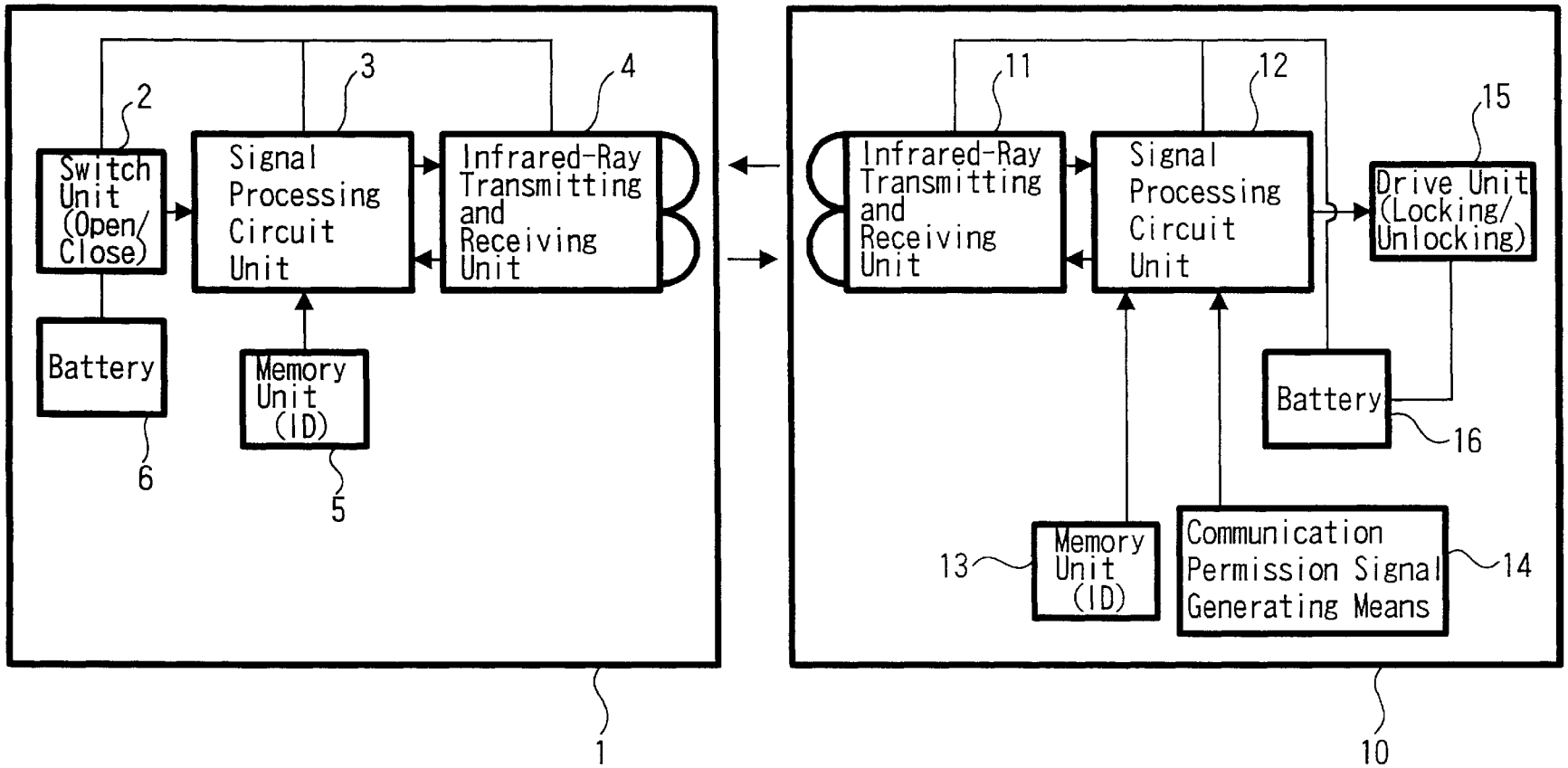
FIG. 1 is a block diagram showing an arrangement of an identification signal checking apparatus according to an embodiment of the present invention.

As shown in FIG. 1, a portable type key apparatus 1 has a switch unit 2 for issuing commands to open and close a door, a signal processing circuit unit 3, an infrared-ray transmitting and receiving unit 4 for communicating with a lock apparatus 10 described later on, and a memory unit 5 for storing a specific (own) identification signal ID.

The signal processing circuit unit 3 is formed of a microcomputer. When the switch unit 2 issues a commend to open or close the door by operating a switch thereof, the signal processing circuit unit 3 generates a communication request signal including a lock/unlock command signal and supplies this communication request signal to the infrared-ray transmitting and receiving unit 4. The infrared-ray transmitting and receiving unit 4 transmits the communication request signal to the lock apparatus 10.

Figures 3A, 3B, 3C, 3D:
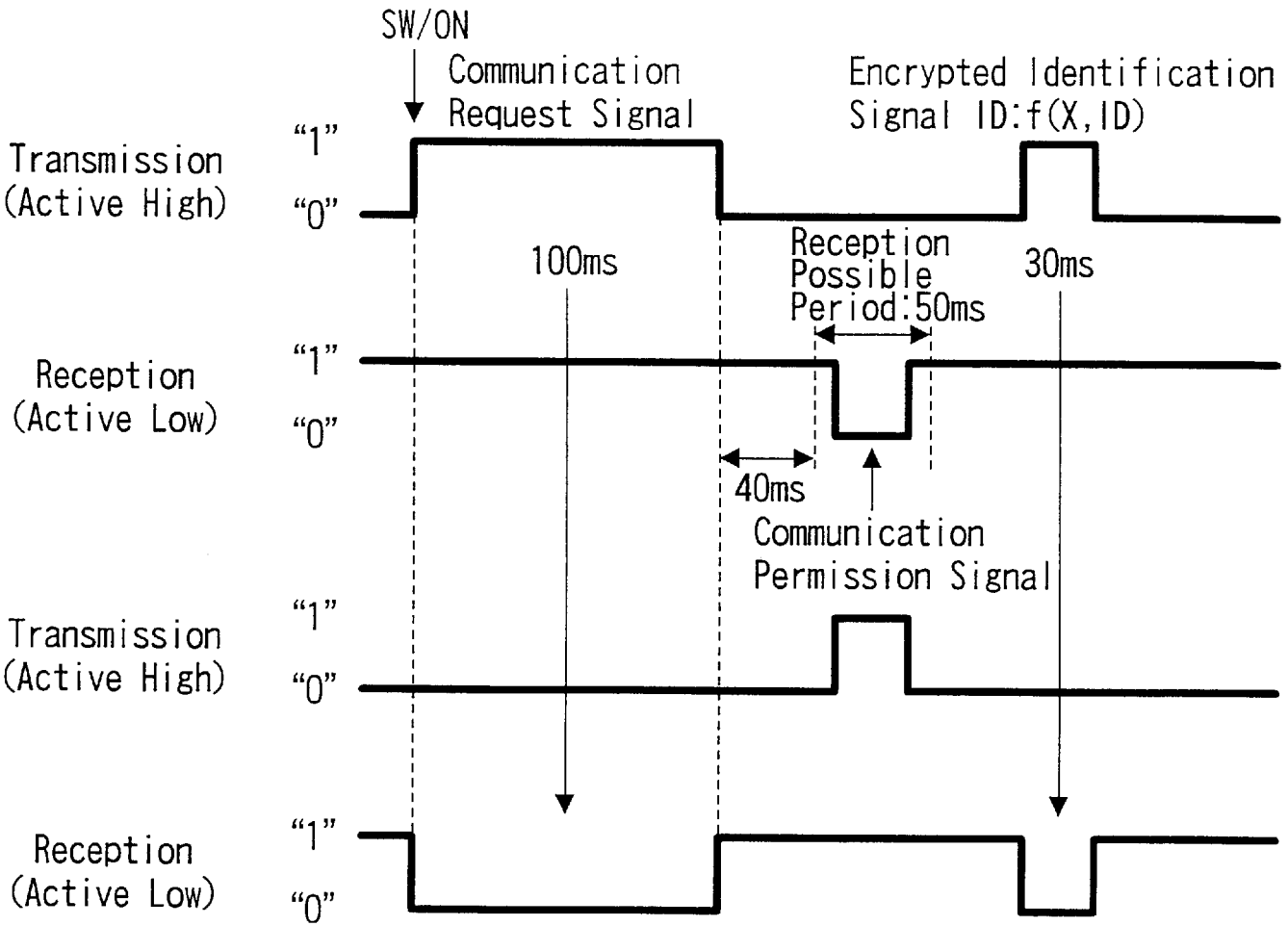
FIGS. 3A to 3D are timing charts used to explain communication between a key apparatus and a lock apparatus according to the embodiment of the present invention.

As shown in FIG. 3A, the signal processing circuit unit 3 sets the infrared-ray transmitting and receiving unit 4 in its reception possible state only for a period of 50 ms succeeding a period of 40 ms after completion of transmission of the communication request signal having a period of 100 ms, for example. Only during this reception possible period, the infrared-ray transmitting and receiving unit 4 receives the communication permission signal from the lock apparatus 10 having a period of 30 ms. In this embodiment, the communication permission signal is formed of a random number signal of 24 bits, for example. In this case, if the infrared-ray transmitting and receiving unit 4 does not receive any communication permission signal during the reception possible period, this communication is stopped.

When the key apparatus 1 receives the communication permission signal formed of the 24-bit random number signal X, for example, from the lock apparatus 10, the signal processing circuit unit 3 encrypts a specific (own) identification signal ID of 24 bits, for example, stored in the memory unit 5 to convert it into a code signal of 24 bits, for example, in accordance with a predetermined function f(X, ID) by using a random number signal X of 24 bits, for example. Then, the signal processing circuit unit 3 supplies the encrypted signal f(X, ID) through the infrared-ray transmitting and receiving unit 4 to the lock apparatus 10.

This function f(X, ID) is defined as shown below, for example, such that if respective corresponding bits of the random number signal X and the identification signal ID have the same value of "1" or "0", then the value of a corresponding bit in the function f(X, ID) is set to "1" and if the respective corresponding bits thereof have the values different from each other, then the value thereof in the function f(X, ID) is set to "0".

| | |
|---|---|
| ID | 010101010101010101010101 |
| X | 110111011101110111011101 |
| f(X, ID) | 011101110111011101110111 |

The infrared-ray transmitting and receiving unit 4 according to this embodiment is arranged so as to carry out communication in accordance with a known base band system. The base band system permits high-speed communication at a lower consumed power and simplifies a circuit arrangement as compared with other modulation systems such as an amplitude shift keying (ASK), a frequency shift keying (FSK) or the like.

The lock apparatus 10 is provided at a predetermined position in association with the door. The lock apparatus 10 has an infrared-ray transmitting and receiving unit 11 for communicating with the key apparatus 1, a signal processing circuit unit 12, a memory unit 13 for storing a specific (own) identification signal ID, a communication permission signal generating means 14 for generating the communication permission signal, and a drive unit 15 for controlling a door locking or unlocking operation based on a command signal from the signal processing circuit unit 12.

A binary counter for processing 24 bits, for example, is employed as the communication permission signal generating means 14. This 24-bit binary counter carries out a count operation in accordance with a predetermined clock signal regardless of the communication. When the lock apparatus 10 receives the communication request signal from the key apparatus 1, the operation of the 24-bit binary counter is stopped and then a count value of the binary counter at this time is read, thereby the communication permission signal formed of the 24-bit random number signal, for example, being obtained.

The signal processing circuit unit 12 is formed of a microcomputer. When the lock apparatus 10 receives the communication request signal from the key apparatus 1, as shown in FIG. 3C, in a period of 50 ms succeeding a period of 40 ms after completion of the communication request signal having a period of 100 ms, for example, the signal processing circuit unit 12 transmits the communication permission signal formed of the random number signal X and generated by the communication permission signal generating means 14 to the key apparatus 1 for a period of 30 ms, for example.

When the lock apparatus 10 receives from the key apparatus 1 the encrypted signal f(X, ID) obtained by encrypting the identification signal ID with the random number signal X, the signal processing circuit unit 12 decrypts the received encrypted signal f(X, ID) in accordance with a predetermined function $f^{-1}\{f(X, ID), X\}$ by using the previously transmitted 24-bit random number signal X, for example, and checks whether or not the identification signal obtained by this decryption is the specific (own) identification signal ID previously stored (registered) in the memory unit 13.

As a result of the check processing, if the decrypted identification signal is agreed with the identification signal ID previously stored (registered) in the memory unit 13, then the signal processing circuit unit 12 supplies a locking/unlocking command signal based on a door opening/closing command included in the communication request signal to the drive unit 15. Then, under the operation of the drive unit 15, the door is opened or closed.

The infrared-ray transmitting and receiving unit 11 according to this embodiment is arranged similarly to the above-mentioned infrared-ray transmitting and receiving unit 4, and arranged so as to carry out communication in accordance with the known base band system. In FIG. 1, batteries 6 and 16 are used to energize the key apparatus 1 and the lock apparatus 10, respectively.

An operation of the keyless entry system for opening and closing a door according to this embodiment will be described with reference to FIG. 2 which is a flowchart therefor and with reference to FIGS. 3A to 3D which are timing charts therefor. In this embodiment, it is assumed that the same specific (own) identification signals ID, e.g., the identification signals ID formed of codes of 24 bits, for example, are previously stored (registered) in the memory units 5 and 13.

Figure 2:
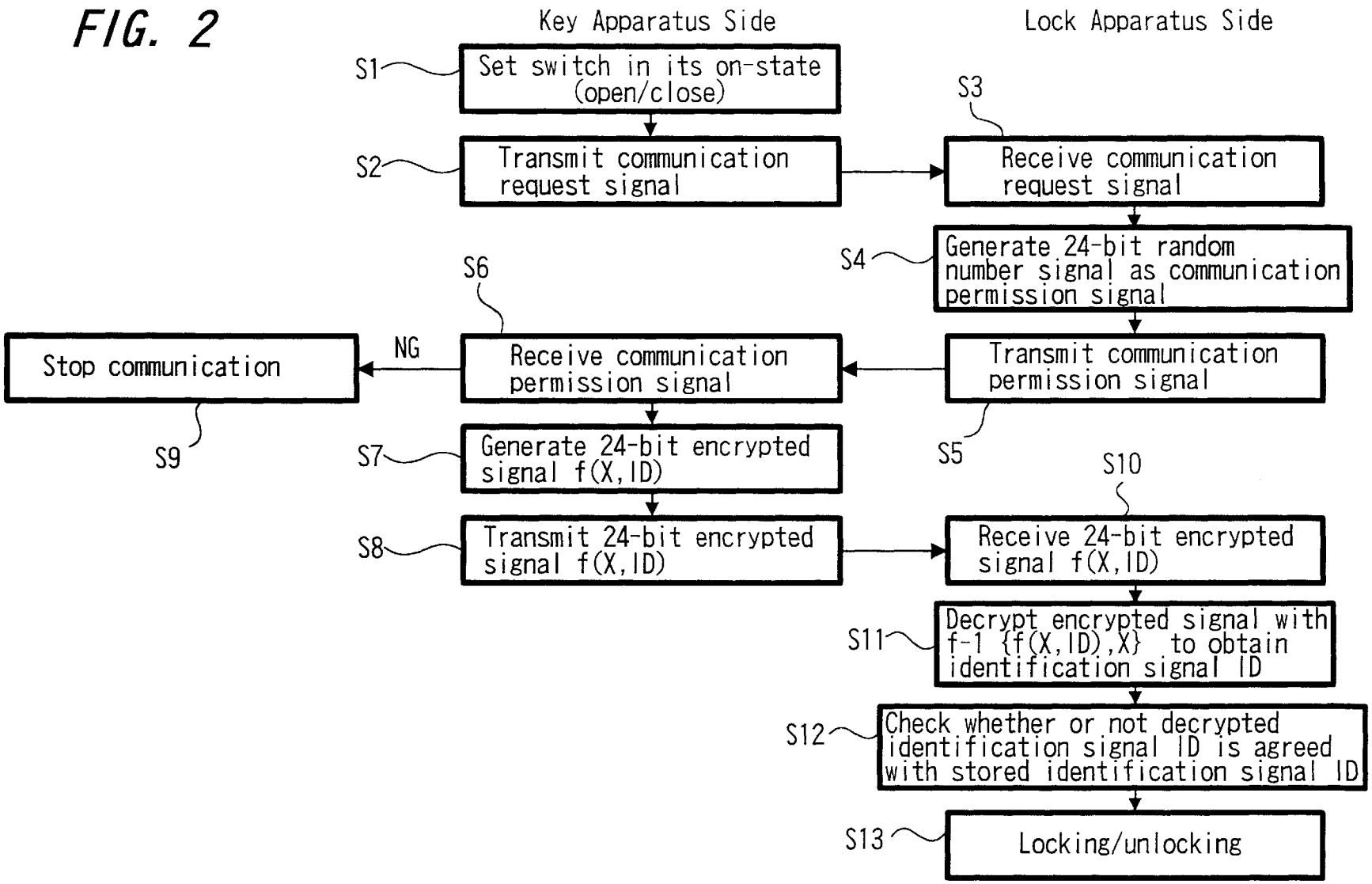
FIG. 2 is a flowchart used to explain an operation of the identification signal checking apparatus according to the embodiment of the present invention.

In step S1 of the flowchart shown in FIG. 2, the switch unit 2 of the key apparatus 1 is operated and the switch thereof is set in its on-state, thereby a command to open or close a door being issued initially. In step S2, as shown in FIG. 3A, for example, the key apparatus 1 transmits the communication request signal including the door opening/closing command signal to the lock apparatus 10 for a period of 100 ms.

In step S3, the lock apparatus 10 receives the communication request signal as shown FIG. 3D. Then, the processing proceeds to step S4, wherein the lock apparatus 10 obtains the communication permission signal formed of the 24-bit random number signal X, for example, generated by the communication permission signal generating means 14 during a period of 50 ms succeeding a period of 40 ms after completion of the communication request signal. In step S5, as shown in FIG. 3C, the lock apparatus 10 transmits the communication permission signal formed of the random number signal X to the key apparatus 1 for a period of 30 ms, for example.

In step S6, the key apparatus 1 receives the communication permission signal formed of the random number signal X during the reception possible period of 50 ms succeeding the period of 40 ms after completion of the communication request signal as shown in FIG. 3B. Then, the processing proceeds to step S7, wherein the key apparatus 1 encrypts the specific (own) identification signal ID stored (registered) in the memory unit 5 to convert it into the 24-bit code signal, in accordance with the predetermined function f(X, ID) by using the 24-bit random number signal X, for example. Then, the processing proceeds to step S8, wherein the key apparatus 1 supplies the encrypted signal f(X, ID) to the lock apparatus 10 during the period of 30 ms, for example, as shown in FIG. 3A. Then, the processing proceeds to step S10.

If in step S6 the key apparatus 1 does not receive the communication permission signal during the reception possible period, then the processing proceeds to step S9, wherein the communication between the key apparatus 1 and the lock apparatus 10 is stopped.

If in step S10 the lock apparatus 10 receives the encrypted signal f(X, ID) as shown in FIG. 3D, then the processing proceeds to step S11, wherein the lock apparatus 10 decrypts the received encrypted signal f(X, ID) in accordance with the predetermined function $f^{-1}\{f(X, ID), X\}$ by using the previously transmitted random number signal X. Then, the processing proceeds to step S12, wherein the lock apparatus 10 checks whether or not the decrypted identification signal ID is agreed with the specific (own) identification signal ID previously stored (registered) in the memory unit 13. As a result of the check processing, if the decrypted identification signal is agreed with the specific (own) identification signal ID previously stored (registered) in the memory unit 13, then the processing proceeds to step S13, wherein, in accordance with the door opening or closing command signal of the communication request signal, the signal processing circuit unit 12 supplies the unlocking or locking command signal to the drive unit 15 for carrying out the unlocking or locking operation of the door. Then, under the control of the drive unit 15, the door is opened or closed.

According to this embodiment, only when the key apparatus 1 receives the communication permission signal from the lock apparatus 10 during the reception possible period, the key apparatus 1 transmits the identification signal to the key apparatus 10. Therefore, the period of transmitting the identification signal is limited, which advantageously improves the security.

According to this embodiment, every time when the operation of opening or closing the door is attempted, the lock apparatus 10 generates the communication permission signal formed of the random number signal X and the key apparatus 1 encrypts the identification signal ID by using the random number signal X and supplies the encrypted signal f(X, ID) to the lock apparatus 10. Therefore, since the signals transmitted in this both-way communication are constantly different, even if these communication signals are intercepted, the specific (own) identification signal ID is prevented from being stolen.

According to this embodiment, even if the operation of opening or closing the door is attempted any times, the possibility that the code signals are agreed with each other by accident is constant, e.g., the possibility is constantly about one over 16.7 million in a case of the 24-bit code signal. Therefore, it is advantageously possible to realize the extremely high security with ease.

While in this embodiment the communication between the key apparatus 1 and the lock apparatus 10 is carried out in accordance with the base band system by using the infrared rays, the communication may be carried out in accordance with some other modulation systems such as the ASK, the FSK or the like by using the infrared rays. It is needless to say that the communication may be carried out by using a radio wave or a supersonic wave instead of the infrared rays.

While in this embodiment the communication permission signal is formed of the random number signal, it is not necessary to form the communication permission signal of the random number signal and it is not necessary to encrypt the identification signal transmitted from the key apparatus 1.

It is not necessary that each of the communication permission signal formed of the random number signal, the identification signal and the encrypted signal is formed of 24 bits. It is sufficient to determine the number of bits thereof in response to a required degree of the security.

While in this embodiment the communication request signal includes the locking or unlocking command signal, the locking or unlocking command signal may be added to the above encrypted signal f(X, ID) or may be transmitted individually.

According to the present invention, only when an apparatus to be detected (the key apparatus) receives the communication permission signal from a detecting apparatus (the lock apparatus) for a predetermined period, for example, the apparatus to be detected (the key apparatus) transmits the identification signal to the detecting apparatus (the lock apparatus). Therefore, the period of transmitting the identification signal is limited, which advantageously improves the security.

Having described a preferred embodiment of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. An identification signal checking apparatus comprising:

a first device having a first wireless transmitting and receiving unit, a first signal processing unit and a first memory unit for storing an identification signal, wherein said first device transmits a communication request signal; and a second device having a second wireless transmitting and receiving unit, a second signal processing unit, a second memory unit for storing an identification signal, and a communication permission signal generating means, wherein said second device transmits a communication permission signal to said first device in response to said communication request signal, wherein said second device begins transmitting said communication permission signal after a first predetermined period following reception of said communication request signal and completes transmission of said communication permission signal within a second predetermined time period after said first predetermined time period;

wherein upon receiving said communication permission signal transmitted from said second device, said first device transmits the identification signal stored in said first memory unit to said second device, and wherein said second device checks whether or not the transmitted identification signal coincides with the identification signal stored in said second memory unit.

2. An identification signal checking apparatus according to claim 1, wherein said communication permission signal is a random number signal, said first device encrypts said identification signal by using said random number signal and transmits it, and said second device decrypts said encrypted identification signal and checks whether or not said decrypted identification signal coincides with the identification signal stored in said second memory unit.

3. An identification signal checking apparatus according to claim 2, wherein in accordance with a predetermined function, said identification signal is encrypted by using said random number signal.

4. An identification signal checking apparatus according to claim 1, wherein said first and second wireless transmitting and receiving units are respectively infrared-ray transmitting and receiving units.

5. An identification signal checking method of an identification signal checking apparatus comprising a first device having a first wireless transmitting and receiving unit, a first signal processing unit and a first memory unit for storing an identification signal, and a second device having a second wireless transmitting and receiving unit, a second signal processing unit, and a second memory unit for storing an identification signal comprising the steps of:

transmitting a communication request signal from said first device to said second device;

transmitting a communication permission signal from said second device to said first device in response to said communication request signal, in which said second device begins transmitting said communication permission signal after a first predetermined period following reception of said communication request signal and completes transmission of said communication permission signal within a second predetermined time period after said first predetermined time period, transmitting, upon reception of said communication permission signal, the identification signal stored in said first memory unit from said first device to said second device; and checking in said second device whether or not the transmitted identification signal coincides with the identification signal stored in said second memory unit.

6. An identification signal checking method according to claim 5, wherein said communication permission signal is a random number signal, said first device encrypts said identification signal by using said random number signal and transmits it, and said second device decrypts said encrypted identification signal and checks whether or not said decrypted identification signal coincides with the identification signal stored in said second memory unit.

7. An identification signal checking method according to claim 6, wherein in accordance with a predetermined function, said identification signal is encrypted by using said random number signal.

8. An identification signal checking method according to claim 5, wherein said first and second wireless transmitting and receiving units are respectively infrared-ray transmitting and receiving units.

9. An identification signal checking apparatus according to claim 1, wherein said first device is a key apparatus, said second device is a lock apparatus, said lock apparatus is provided with a locking means and/or an unlocking means, said lock apparatus controls said locking means and/or said unlocking means based on a check output indicative of whether or not the transmitted identification signal coincides with the identification signal stored in said second memory unit.

10. An identification signal checking method according to claim 5, wherein said first device is a key apparatus, said second device is a lock apparatus, said lock apparatus is provided with a locking means and/or an unlocking means, said lock apparatus controls said locking means and/or said unlocking means based on a check output indicative of whether or not the transmitted identification signal coincides with the identification signal stored in said second memory unit.

11. An identification signal checking apparatus according to claim 1, wherein said first predetermined time period is approximately 40 ms.

12. An identification signal checking apparatus according to claim 11, wherein said second predetermined time period is approximately 50 ms.

13. An identification signal checking method according to claim 5, wherein said first predetermined time period is approximately 40 ms.

14. An identification signal checking method according to claim 5, wherein said second predetermined time period is approximately 50 ms.

* * * * *